United States Patent [19]

Shavit

[11] Patent Number: 4,669,253

[45] Date of Patent: Jun. 2, 1987

[54] METHOD AND APPARATUS FOR TRANSFORMING SEMIRIGID BLANKS INTO CONTAINERS

[75] Inventor: Henri Shavit, Arlesheim, Switzerland

[73] Assignee: Werner Brogli, Duggingen, Switzerland; a part interest

[21] Appl. No.: 729,802

[22] Filed: May 2, 1985

[30] Foreign Application Priority Data

May 5, 1984 [EP] European Pat. Off. ..... 84105079.2

[51] Int. Cl.[4] ..... B65B 47/00

[52] U.S. Cl. ..... 53/455; 53/562; 493/174; 493/213; 493/929

[58] Field of Search ..... 493/167, 174, 175, 169, 493/153, 133, 87, 213, 929; 53/562, 550, 547, 563, 455, 452

[56] References Cited

U.S. PATENT DOCUMENTS

| | | | |
|---|---|---|---|
| 2,209,448 | 7/1940 | Dunlap | 229/5.5 |
| 2,432,462 | 12/1947 | Waters | 222/107 |
| 2,679,966 | 6/1954 | Berch et al. | 226/97 |
| 2,691,259 | 10/1954 | Weckesser | 53/9 |
| 2,947,653 | 8/1960 | Glattbrugg | 154/83 |
| 3,041,941 | 7/1962 | Danielzig . | |
| 3,145,630 | 8/1964 | Moore | 493/167 X |
| 3,382,644 | 5/1968 | Vogt | 53/29 |
| 3,502,521 | 3/1970 | Doyen et al. | 156/69 |
| 3,513,618 | 5/1970 | Woodruff et al. | 53/27 |
| 4,010,676 | 3/1977 | Eilenberg et al. | 493/167 |
| 4,252,052 | 2/1981 | Meyers et al. | 493/167 X |
| 4,394,936 | 7/1983 | Shavit | 222/107 |

FOREIGN PATENT DOCUMENTS

| | | |
|---|---|---|
| 538036 | 5/1955 | Belgium . |
| 547082 | 5/1956 | Belgium . |
| 0041924 | 6/1981 | European Pat. Off. . |
| 0078471 | 5/1983 | European Pat. Off. . |
| 3308112 | 9/1984 | Fed. Rep. of Germany . |
| 1052490 | 1/1954 | France . |
| 1186975 | 9/1959 | France . |
| 2181620 | 7/1973 | France . |
| 2351870 | 12/1977 | France . |
| 6612697 | 3/1968 | Netherlands . |
| 603423 | 12/1977 | Switzerland . |
| 548474 | 10/1942 | United Kingdom . |

*Primary Examiner*—James E. Coan

*Attorney, Agent, or Firm*—Peter K. Kontler

[57] ABSTRACT

Rectangular blanks of laminated cardboard are converted into containers for foodstuffs or the like in an apparatus wherein the central portion of a blank is clamped between two coaxial tools one of which has a concave blank-contacting surface and the other of which has a complementary convex blank-contacting surface. The tools can enter the cavity of a matrix with edges at one end of the cavity serving to cooperate with edges bounding the surfaces of the two tools so as to define pronounced boundaries between the clamped portion and the adjacent outer portions of the blank. The tool with the concave front surface is caused to penetrate into the cavity and to push the other tool in front of it whereby the outer portions of the blank are converted into a pair of sidewalls with convex outer sides. The thus deformed blank is expelled from the cavity of the matrix and is transported to a series of additional stations where certain marginal portions of the sidewalls are partially bonded to each other, where the containers receive supplies of filler material and where the containers are finally sealed along the remaining marginal portions of the sidewalls.

52 Claims, 14 Drawing Figures

70
21
22
19
20
31
45
44
43
100
56
51
50
Pf1
46
48
9
6
8

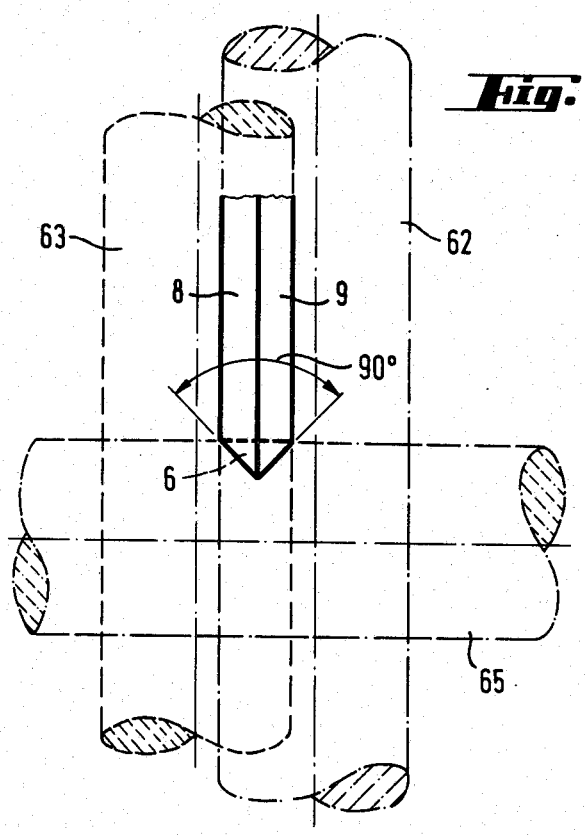
Fig. 11
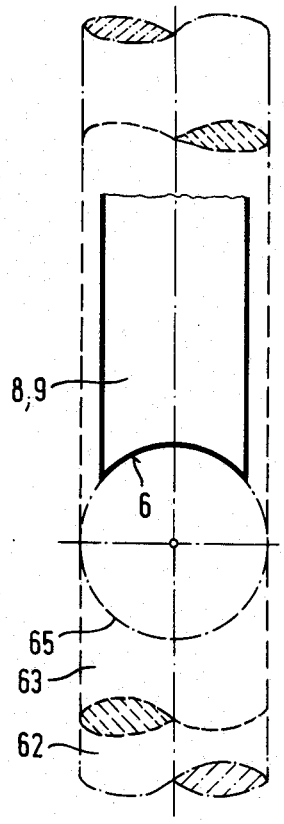
Fig. 12
Fig. 13
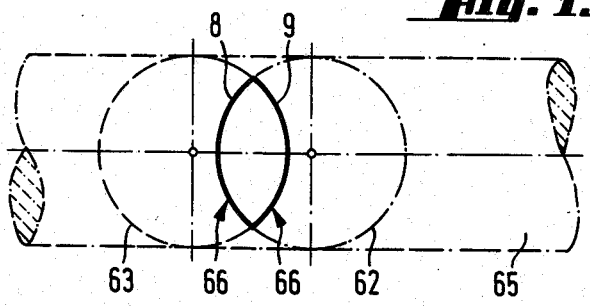

METHOD AND APPARATUS FOR TRANSFORMING SEMIRIGID BLANKS INTO CONTAINERS

The present invention relates to improvements in methods and apparatus for making containers, and more particularly to improvements in methods and apparatus for making containers from preferably flat semirigid blanks, especially from blanks consisting of laminated cardboard or the like. Still more particularly, the invention relates to a method and apparatus for making containers of the type having two preferably mirror symmetrical bonded-together sidewalls with convex outer sides and an end wall or bottom wall having a concave outer side and being integral with the adjacent portions of the sidewalls.

Containers of the above outlined character are disclosed, for example, in European Pats. Nos. 0 041 924 and 0 078 471 as well as in German Pat. No. 33 03 112.3. The making of such containers presents numerous problems which are attributable primarily, or to a considerable extent, to the nature of the material of the blanks. Thus, the blanks normally contain a central layer of semirigid paper or cardboard which cannot be stretched, the outer side of which is coated with a thin aluminum foil and the inner side of which is lined with a layer of synthetic thermoplastic material (e.g., polyethylene). The material of the semirigid layer tends to break in the regions where it is being bent, i.e., to lose its rigidity (either entirely or in part) in each of those portions which are subjected to bending or flexing, e.g., in order to establish definite boundaries between the end wall and the sidewalls of the container. Heretofore known proposals merely deal with the treatment of marginal portions of a finished container because the treatment of any other portions could result in permanent damage to the corresponding wall or walls. The nature of the aforediscussed semirigid material renders it impossible to assemble such containers in the form of flat bags with two overlapping panels which are bonded to each other at two opposite sides and are thereupon expanded by introducing a ram between the panels in a manner as disclosed, for example, in published French patent applications Ser. Nos. 2 181 620 and 2 351 870 for the purpose of providing the bags with bottom walls or end walls. The apparatus which are disclosed in these French applications are incapable of providing the bags with well defined boundaries between the sidewalls and the end wall or bottom wall. Such well defined (sharp) boundaries are desirable and advantageous because they enhance the stability of the containers, i.e., they prevent undesirable changes in the shape of the finished products. The apparatus of the French patent applications are designed to provide the bottom or end wall of each container with a centrally located fold line so that the two halves of the end wall act not unlike the leaves of a hinge which greatly reduces the stability of the end wall and of the entire container, i.e., the end wall is incapable of maintaining the sidewalls out of contact with each other or of preventing undesirable movements of the sidewalls toward one another. Therefore, the just discussed apparatus are usable only for the making of readily deformable expandible elastic bags or analogous more or less flat containers.

Belgian Pat. No. 538 036 discloses a method according to which an upper tool is designed to force an originally flat blank well into the opening of a matrix to thus convert certain portions of the blank into the sidewalls of a container. In the next step, a second tool is introduced into the matrix from below so as to provide the blank with a bottom wall or end wall. The two tools are further used to transfer the marginal portions of the thus obtained container between welding tools which bond the entire marginal portions of one sidewall to the corresponding marginal portions of the other sidewall. The resulting container is expelled from the matrix in a downward direction and the lower tool is thereupon caused to return into the interior of the matrix. The just discussed method (according to which the sidewalls of a container are formed ahead of the end wall or bottom wall) cannot be practiced in connection with the making of containers wherein the sidewalls and the end wall are to be formed simultaneously and wherein well defined or distinct continuous boundaries are to be established between the end wall and each of the sidewalls. Another drawback of the just discussed patented method is that a cycle is completed only when the marginal portions of sidewalls are bonded to each other, i.e., the intervals for completion of successive cycles are too long because the tools which are used to deform the blank also serve to transfer the deformed blank to the bonding station and to hold the blank during welding of the marginal portions of the sidewalls to each other. Therefore, such method is not suitable for the mass-production of containers with externally convex sidewalls flanking an externally concave end wall or bottom wall.

The apparatus which is disclosed in the aforediscussed Belgian patent employs a matrix with a cavity whose outline corresponds to the outline of the container to be formed therein. The edge bounding the inlet end of the cavity is rounded so as to facilitate penetration of a blank into the matrix. This renders it impossible to establish well defined boundaries between the sidewalls and the end wall of the container, i.e., the boundaries are established in a more or less haphazard fashion which adversely affects the appearance and stability of the finished product. Therefore, the lower tool which is introduced into the matrix in the next-following step is likely to deform the partially deformed blank in regions other than those which underwent deformation during forcible introduction of the blank into the cavity of the matrix by the upper tool. The provision of several boundaries (first by the matrix in cooperation with the upper tool and thereupon by the lower tool) detracts from the appearance of the finished container because the more or less haphazardly formed boundaries which develop as a result of forcible introduction of the blank into the cavity of the matrix in response to downward movement of the upper tool do not disappear during subsequent deformation of the blank by the ascending lower tool. In other words, the patented apparatus is likely to weaken the container exactly in the region or regions where the container should exhibit pronounced stability, namely along the boundaries between the sidewalls and the end wall.

The apparatus which is disclosed in the Belgian patent exhibits the additional drawback that it does not have any means for guiding the marginal portions of the sidewalls during penetration of the blank into the cavity of the matrix. This invariably results in at least some misalignment of the marginal portions of the sidewalls so that the container must be subjected to a costly and time-consuming secondary treatment in a trimming device. At least some shifting of the sidewalls relative to each other is also likely to take place immediately prior to as well as during bonding of the marginal portions of the sidewalls to each other. Trimming of the finished containers not only involves additional expenditures and takes up additional time but the apparatus must also be equipped with means for gathering and evacuating the removed material. The provision of lateral guides for the marginal portions of containers in the apparatus of the Belgian patent would serve little useful purpose because the blank which is being forced into the cavity ofthe matrix is compelled to move in the direction or directions which are dictated by the descending upper tool and the adjacent portions of the matrix so that, even if available, guide means for the marginal portions of the sidewalls of the blank which is in the process of developing two sidewalls could not prevent at least some lateral shifting of the marginal portions of such sidewalls relative to each other.

A further apparatus for the making of containers with two sidewalls and an end wall is disclosed in French Pat. No. 1 186 975. The patented apparatus employs a first tool and a battery of additional tools which are attached to a chain. The apparatus further employs an articulated matrix with wall sections which are connected to each other by hinges and face those portions of a blank which are to be converted into boundaries between the walls of a container. The apparatus is quite complex, expensive and prone to malfunction. Also, the apparatus is subject to pronounced wear because it contains a substantial number of movable parts. Still further, such apparatus cannot be used for the making of containers with arcuate boundaries between the sidewalls and the end wall and/or with externally convex sidewalls. Moreover, the edges of the finished container must be trimmed because the alignment of marginal portions of one of the sidewalls with the marginal portions of the other sidewall is far from satisfactory. The resulting dust and fragments of containers contaminate the containers and the containers must be evacuated at a substantial additional cost. Fragments of blanks and/or dust in the interior of the containers create sanitary problems so that the containers must be subjected to additional treatment, especially if they are to receive certain types of (e.g., edible) filler material. Still further, the finished container tends to close automatically (i.e., to reduce its volume) so that it is necessary to provide a device which opens the container prior to filling. Last but not least, and since the numerous additional tools are attached to a chain, they cannot be readily moved upwardly into the interior of the composite matrix so that the matrix and/or other parts must be moved relative to the containers on or between the tools which is a costly, complex and cumbersome procedure.

Apparatus which are used for the making of elastically deformable containers and/or for the making of containers with straight boundaries between the neighboring walls are disclosed in U.S. Pat. No. 3,382,644 to Vogt, British Pat. No. 548 474 to Winternitz, U.S. Pat. No. 2,432,462 to Waters, U.S. Pat. No. 2,947,653 to Föhor, U.S. Pat. No. 3,145,630 to Moore, U.S. Pat. No. 2,502,521 to Doyen, U.S. Pat. No. 2,209,448 to Dunlap, U.S. Pat. No. 2,691,259 to Weckesser, U.S. Pat. No. 3,041,947 to Danielzig, French Pat. No. 1 052 490 to I. D. Plastic, Swiss Pat. No. 603 423 to Wifor.

OBJECTS AND SUMMARY OF THE INVENTION

An object of the invention is to provide a novel and improved method of making containers in such a way that the blanks are provided with definite boundaries only in the regions where the neighboring walls are integrally connected with each other.

Another object of the invention is to provide a method which renders it possible to turn out large numbers of identically shaped containers per unit of time and which renders it unecessary to trim the finished products.

A further object of the invention is to provide a method which can be practiced for the making of containers from blanks consisting of or containing a semirigid material, such as paper or cardboard with or without one or more coatings, and which ensures the making of containers with accurately aligned marginal portions of the sidewalls.

An additional object of the invention is to provide a novel and improved method of making containers within a fraction of the time which is required for the making of similar containers in accordance with conventional methods.

Still another object of the invention is to provide a novel and improved apparatus for the practice of the above outlined method.

A further object of the invention is to provide the apparatus with novel and improved means for converting flat or substantially flat blanks of semirigid material into containers of the type having a pair of sidewalls with convex outer sides and an end wall or bottom wall with a concave outer side.

Still another object of the invention is to provide the apparatus with novel and improved means for transporting blanks to and for transporting finished of partly finished containers away from the converting station.

An additional object of the invention is to provide an apparatus which can treat blanks consisting of or containing a semirigid material with a degree of predictability and reproducibility greatly exceeding that of heretofore known apparatus and which is capable of accurately guiding and locating the portions of blanks during each and every stage of treatment so that the finished product need not be trimmed and/or otherwise manipulated in order to compensate for inaccurate guidance and/or transport.

A further object of the invention is to provide the apparatus with novel and improved means for bonding portions of successive partially finished containers to each other.

Another object of the invention is to provide an apparatus which treats the blanks and the containers gently and which does not leave any unsightly or strength-affecting marks on the products.

An additional object of the invention is to provide the apparatus with novel and improved means for rapidly and predictably converting flat blanks of cardboard or the like into partially finished containers with two externally convex sidewalls and an externally concave end wall.

One feature of the invention resides in the provision of a method of making from a deformable sheet-like blank (particularly from a blank which consists of or contains a semirigid material, e.g., laminated cardboard) a container of the type wherein two sidewalls having at least partially convex outer sides, adjacent first longitudinal marginal portions, adjacent second longitudinal marginal portions and adjacent transverse marginal portions are integral with and define (preferably but not necessarily arcuate) boundaries with an end wall which is located opposite the transverse marginal portions and has a concave outer side. The method comprises the steps of converting a substantially centrally located (preferably at least substantially lenticular or oval) first portion of the blank between two outer blank portions into the end wall of the container including applying requisite pressure to opposite sides of the first portion by the confronting complementary concave and convex surfaces of first and second deforming tools, simultaneously impressing the boundaries between the thus obtained end wall and the outer portions of the blank, and simultaneously or immediately thereafter folding the outer portions of the blank along the respective boundaries to transform such outer portions of the blank into the sidewalls of the container.

The folding step preferably includes introducing the converted first portion of the blank which is clamped between the deforming tools into the cavity of a mold or matrix in a direction such that the outer portions of the blank are folded along the first tool (i.e., along the tool having the concave surface). The method preferably further comprises the steps of expelling the blank from the cavity of the matrix, including moving the blank along an at least substantially straight path with the end wall leading (i.e., the end wall is located at the lower end of the deformed blank if the latter is moved downwardly), and thereupon transporting the expelled blank sideways, e.g., to a further processing station.

The method can further comprise the steps of providing the first portion of the blank with an aperture, preferably prior to the converting step, and thereupon centering the blank with reference to at least one of the deforming tools and the matrix through the medium of the aperture in the first portion of the blank.

The method preferably further comprises the steps of establishing a source of discrete (prefabricated) blanks, and advancing successive discrete blanks from the source into the space between the deforming tools. Alternatively, the method can comprise the steps of establishing a series (e.g., a roll) of coherent blanks, separating (e.g., severing) successive blanks from the remaining blanks of the series, and advancing the separated blanks between the deforming tools.

The method can also comprise the step of bonding the marginal portions of one sidewall to the corresponding marginal portions of the other sidewall, and such bonding step can include for example the application of heat, electronic sewing (high-frequency welding) or ultrasonic welding.

The bonding step can be carried out in several stages. Thus, such bonding step can include sealingly securing some (e.g., the longitudinally extending) marginal portions of the two sidewalls to each other in a first step and sealingly securing the remaining (transverse) marginal portions of the sidewalls to each other in a second step. The remaining marginal portions then define between themselves an opening upon completion of the first securing step, and the method can comprise the additional step of filling the container (e.g., with a flowable edible or other material) by way of the opening prior to the second securing step.

Another feature of the invention resides in the provision of an apparatus for transforming deformable sheet-like blanks, particularly semirigid blanks consisting of laminated cardboard or the like, into containers of the type wherein two sidewalls having convex outer sides and including neighboring marginal portions are integral and define more or less distinct boundaries with an end wall whose outer side is concave. The apparatus comprises at least one blank converting unit having preferably coaxial first and second deforming tools which are respectively provided with confronting complementary concave and convex surfaces bearing against the opposite sides of a substantially centrally located first portion of a blank (e.g., an elongated rectangular blank made of or containing paper and/or cardboard) which first portion is flanked by two outer portions of the blank. This converts the first portion of the blank into the end wall of a container because the concave and convex surfaces of the first and second tools respectively correspond to the concave outer side and the convex opposite or inner side of the thus obtained end wall. The first and second tools further have first and second edges which bound or delimit the respective surfaces, and the blank converting unit further comprises a matrix which defines a cavity for the passage of the two tools therethrough. The cavity has an outline matching that of the deformed first portion of the blank which is held between the two tools, and the matrix is further formed with an edge which bounds or delimits one end of the cavity and cooperates with the edges of the two tools (or with the edge of at least one of the tools) to define the boundaries between the deformed first portion and the outer portions of the blank which is held between the tools. Such formation of boundaries takes place in response to penetration of the first tool into the cavity. The edge of the matrix further initiates or effects at least partial folding of the outer portions of the blank between the two tools along one of the tools (normally along the first tool). The apparatus further comprises means for moving the tools relative to the matrix in predetermined directions, preferably in the directions of the common axis of the two tools.

The concave and convex surfaces preferably constitute portions of cylindrical surfaces having identical radii. Also, the cavity of the matrix and the two tools preferably have substantially lenticular cross-sectional outlines. Each of the edges preferably includes two substantially arcuate sections which make two acute angles with one another, and the matrix is preferably formed with an elongated transversely extending substantially V-shaped recess or cutout which is adjacent to the one end of the cavity. The acute angles defined by the two sections of the edge at the one end of the matrix are located in the deepmost portion of the recess.

As mentioned above, the cavity of the matrix preferably exhibits a substantially lenticular cross-sectional outline, and the cavity has two narrowest portions which are located opposite to and are spaced apart from each other. Such matrix is preferably further provided with two elongated parallel grooves which communicate with the narrowest portions of the cavity and serve to receive the longitudinally extending marginal portions of the blank whose first portion is clamped between the surfaces of the two tools when the first tool is caused to penetrate into the cavity so that the two outer portions of the blank are then compelled to enter the cavity and their longitudinally extending marginal portions enter the respective grooves of the matrix. The internal surfaces of the matrix which surround the two grooves serve to guide the respective longitudinal marginal portions of the two outer portions of the deformed blank during penetration of the first tool into the cavity.

The peripheral surface of each of the two tools is preferably composed of two mirror symmetrical or substantially mirror symmetrical convex halves and the radius of curvature of each such convex half preferably equals or closely approximates the radii of curvature of the aforementioned concave and convex blank-deforming surfaces. The internal surface of the matrix (i.e., the surface surrounding the cavity) preferably also consists of two mirror symmetrical halves which constitute portions of two identical or substantially identical cylindrical surfaces. The axes of these identical cylindrical surfaces are preferably parallel to the common axis of the two tools, i.e., they are normal to the axes of the cylindrical surfaces portions of which constitute the concave and convex surfaces of the respective tools.

In accordance with a modification, the edges of the tools and of the matrix have polygonal outlines with preferably at least substantially straight facets. This results in the formation of a container whose end wall has a polygonal outline which may be desirable or advantageous for convenience of stacking or for ornamental purposes.

The apparatus is preferably further equipped with means for transporting at least partially finished containers away from the blank converting unit. Such transporting means can comprise at least one receptacle (e.g., a substantially block shaped member with a passage therein dimensioned to receive a partially deformed blank with a finished end wall and partially or nearly finished sidewalls) which is movable along a path extending transversely of the common axis of the tools and along the other end of the cavity in the matrix. The receptacle is arranged to receive a deformed blank from the cavity of the matrix in response to expulsion of such blank from the matrix by one of the tools (as a rule by the first tool whose front surface is a concave surface), and the transporting means further comprises means (e.g., a chain with links connected to a battery of receptacles) for conveying the receptacle substantially transversely of the predetermined direction and preferably along an endless path. The conveying means is or can be designed to advance the receptacle or receptacles stepwise along a predetermined path (e.g., along the aforementioned endless path), and the apparatus preferably comprises at least one additional unit which is adjacent to the predetermined path and has means for treating the deformed blank which is delivered thereto by a receptacle. The additional unit can comprise means for bonding the marginal portions of the outer portions of the deformed blank to each other. The additional unit (or one of several additional units) can comprise means for introducing a filler material (e.g., a flowable foodstuff) into the interior of each deformed blank. Each additional unit preferably includes means for removing deformed blanks from and/or means for reintroducing such blanks into a receptacle. The provision of reintroducing means may not be necessary in the last additional unit because the finished containers can be discharged (e.g., by way of a suitable chute) to a collecting station without reintroduction into the receptacle or into one of several receptacles. The means for moving the tools of the blank converting unit can comprise means for moving the first tool between a first position in which the edge of the first tool is remote from the edge at the one end of the cavity in the matrix so that a fresh blank can be placed between the first tool and the matrix in such position that the aforementioned first portion of the blank overlies the one end of the cavity and a second position in which the first tool extends into the cavity whereby the first tool advances the first portion of the inserted blank (i.e., of the blank which was overlying the one end of the cavity) into the interior of the matrix. The moving means preferably further comprises means for moving the second tool between a first position in which the edge of the second tool is adjacent to the edge of the matrix and a second position in response to penetration of the first tool into the cavity so that the first portion of the blank between the two tools is clamped between the concave and convex surfaces of these tools.

The matrix can be provided with a pair of folding surfaces (particularly the surfaces bounding the aforementioned V-shaped recess in the matrix at the one end of the cavity) which serve to fold the outer portions of the blank whose first portion is held between the concave and convex surfaces of the two tools while the first tool penetrates into the cavity whereby the outer portions of the blank are caused to extend along the periphery of the first tool, i.e., in a direction away from the second tool.

The means for moving the first tool is preferably designed to move the second tool from its first position in response to movement of the first tool from its first to its second position, i.e., in response to penetration of the first tool into the cavity of the preferably stationary matrix. The length of the stroke of the first tool from its first to its second position can be such that the entire deformed blank is located outside of the cavity when the first tool reaches its second position so that the thus expelled freshly deformed blank can be transported to the next unit, i.e., away from a position of register with the cavity and the tools. Thus, the moving means for one of the tools can be said to comprise or constitute a means for expelling deformed blanks from the cavity through the medium of the one tool, and the aforementioned transporting means then advances successive expelled blanks from the position of register with the cavity of the matrix (i.e., away from the blank converting unit) to the next unit, such as the aforementioned bonding unit which can comprise a pair of jaws serving to clamp the marginal portions of the outer portions of the deformed blank so that the marginal portions or certain marginal portions of one outer portion overlie the marginal portions or certain marginal portions of the other outer portion. The bonding unit can further comprise a pair of guide means for the marginal portions of the outer portions of deformed blanks and a receptacle having a chamber whose outline matches or closely approximates the outline of a deformed blank. Such chamber receives a deformed blank while the marginal portions of the blank are being bonded to each other, e.g., in response to the application of heat or in another suitable way.

The convex surface of the second tool is preferably located in the V-shaped recess in the upper end face of the matrix when the second tool assumes its second end position. Such recess is preferably bounded by two folding surfaces which make an angle of substantially 90 degrees.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 11 illustrates the presently preferred mode of designing the peripheral and blank-engaging surfaces of the two tools as well as the surface bounding the cavity of the matrix;

FIG. 12 is a view as seen from the left-hand side of FIG. 11;

FIG. 13 is a top plan view of the matter shown in FIG. 11; and

DESCRIPTION OF THE PREFERRED EMBODIMENTS

Figure 1:
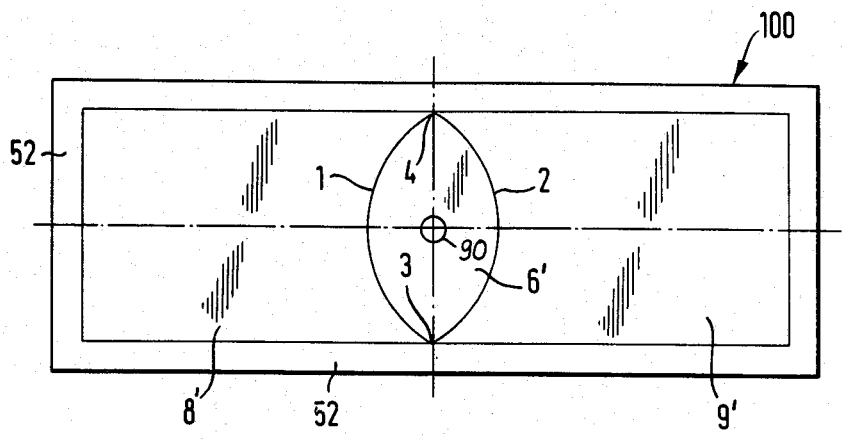
FIG. 1 is a plan view of a rectangular blank which can be converted into a container in accordance with the method and in the apparatus of the present invention.
Figure 2:
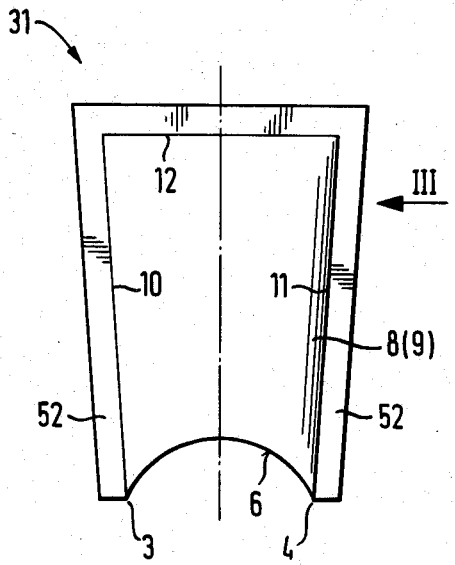
FIG. 2 is a side elevational view of a finished container.
Figure 3:
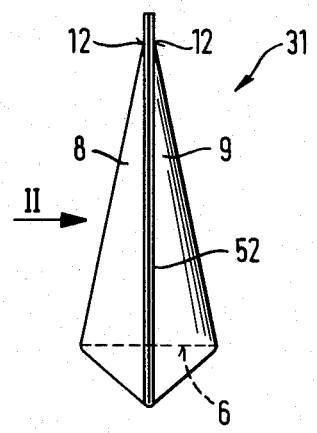
FIG. 3 is an elevational view of the container which is shown in FIG. 2.

Referring first to FIG. 1, there is shown a flat rectangular sheet-like or panel-like blank 100 which is to be converted into a container 31 of the type shown in FIGS. 2 and 3. The blank 100 comprises a centrally located first portion 6' which has a substantially lenticular (biconvex) shape between two imaginary boundaries 1 and 2 separating the first portion 6' from two mirror symmetrical outer portions 8' and 9'. The first portion 6' of the blank 100 is formed with a centrally located centering aperture 90, and such aperture can receive a sealable nipple (not specifically shown) which can be utilized to dispense the contents of the fully assembled container 31. The boundaries 1 and 2 constitute portions of circles having identical diameters. It can be said that the centrally located first portion 6' of the blank 100 resembles a body which is assembled of two segments with their chords placed next to each other. The reference characters 52 denote in FIG. 1 two mirror symmetrical strip-shaped parts of the outer portions 8', 9' which must be at least partially bonded to each other in order to complete the conversion of the blank 100 into a container 31 (save for the aperture 90 if such aperture is provided at all). It is not necessary to bond the entire left-hand half to the entire right-hand half of the strip 52; it suffices to bond the outer portions 8' and 9' to each other only along relatively narrow linear marginal portions including two substantially parallel elongated longitudinally extending marginal portions 10, 11 and a transversely extending marginal portion 12 (see FIGS. 2 and 3).

The container 31 of FIGS. 2 and 3 has an end wall 6, which is the converted first portion 6' of the blank 100, and two sidewalls 8, 9 which are the converted outer portions 8', 9' of the blank 100. The end wall 6 is located opposite the linearly extending bonded-together transverse marginal portions 12 of the container 31 and has a concave outer side. The sidewalls 8 and 9 have convex outer sides and are mirror symmetrical to each other with reference to the plane including the bonded-together pairs of marginal portions 10, 11 and 12. The reference characters 3 and 4 denote the two apices of the lenticular first portion 6' and the apices of the end wall 6. The boundaries 1 and 2 become pronounced, or at least reasonably well defined, in response to conversion of the first portion 6' into the end wall 6 and they are even more pronounced in response to conversion of the outer portions 8', 9' into the respective sidewalls 8, 9. The apices 3 and 4 are respectively adjacent to the nearest marginal portions 10 and 11 of the sidewalls 8, 9 when the conversion of the blank 100 into a container 31 is completed or nearly completed.

Figure 4:
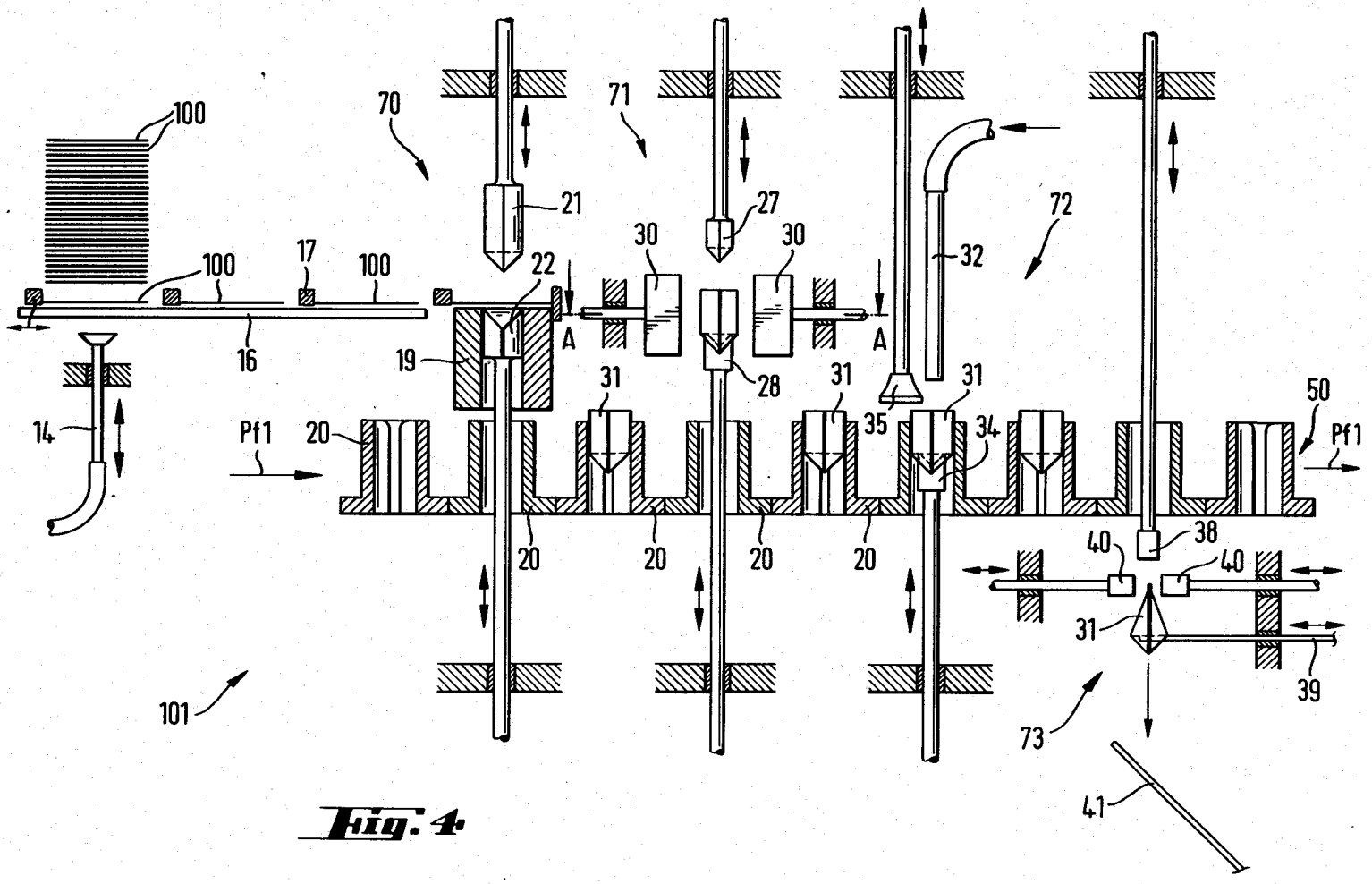
FIG. 4 is a schematic partly elevational and partly vertical sectional view of an apparatus which embodies one form of the invention.

FIG. 4 shows schematically a portion of an apparatus 101 which can be used to transform blanks 100 into containers 31 in accordance with one embodiment of the present invention. The apparatus 101 comprises a blank converting unit 70, a first additional unit 71 (which can be used to bond the marginal portions 10 and 11 of the outer portion 8' to the corresponding marginal portions 10, 11 of the outer portion 9' of a deformed blank), a second additional unit 72 which can be used to introduce metered quantities of a filler material (e.g., a liquid, pulverulent, granular or pasty foodstuff) through the opening 95 between the still unconnected transverse marginal portions 12 of the sidewalls 8, 9 of the container (deformed blank) 31 at the respective station, and a further additional unit 73 which includes means for bonding the transverse marginal portions 12 of successive containers 31 to each other so as to ensure that the material which is admitted by the unit 72 is properly confined in the interior of the respective container.

FIG. 4 further shows a source 92 of discrete blanks 100 which are stacked on top of each other and are disposed at a level above the horizontal or substantially horizontal path of an endless band or belt conveyor 16 (or another suitable conveyor) having pivotable pushers 17 serving to advance successive blanks 100 from the source 92 into the blank converting unit 70. The conveyor 16 cooperates with a suction generating device having a vertically reciprocable suction cup 14 which can attract successive lowermost sheets 100 of the stack to lower the thus attracted sheets 100 into the path of movement of oncoming pushers 17 for transport to the unit 70.

In lieu of or in addition to the suction cup 14, the means for supplying blanks 100 to the blank converting unit 70 can comprise a series (e.g., a roll 93) of coherent blanks 100 which are advanced stepwise through the gap between a mobile and a stationary knife at a severing or separating station 94 (the two knives are denoted schematically by arrows). The knives at the station 94 separate successive foremost blanks 100 from the roll 93, and such foremost blanks are thereupon advanced into the unit 70. If the blanks 100 of the roll 93 are partially separated from each other by rows of perforations or in a similar way, the severing means at the station 94 can be replaced with means (such as pairs of intermittently driven advancing rolls, not shown) for pulling successive foremost blanks of the roll 93 forwardly with a force which suffices to break the remaining bond between the foremost blank and the next-following blank. The exact construction of the means for supplying blanks 100 forms no part of the present invention; all that counts is to ensure that the blank converting unit 70 receives blanks 100 in proper orientation and at required intervals.

The details of the blank deforming unit 70 are further shown in FIGS. 5 to 10. This unit comprises two coaxial deforming tools 21 and 22, means 121, 122 for moving the tools 21, 22 between predetermined first and second end positions, and a stationary mold or matrix 19 which is disposed at a level below the upper tool 21 when the latter assumes the first or upper end position of FIGS. 4, 5, 6, 9 and 10. The matrix 19 and the lower tool 22 can be said to respectively constitute the stationary and mobile components of a two-piece female mold which cooperates with the male mold (upper tool) 21. The matrix 19 is mounted at a level above a transporting device 50 for partially deformed blanks 100 (i.e., for partially finished containers 31). The transporting device 50 comprises a series of articulately connected or independently movable block-shaped receptacles 20 each of which has a passage or chamber for a partially deformed blank 100. The receptacles 20 are transported stepwise along a preferably endless path by a suitable conveyor, e.g., by a link chain which is indicated schematically by an arrow Pf1. The receptacles 20 transport successive deformed blanks 100 from the unit 70 to the unit 71, thence to the unit 72 and then to the unit 73 from which the finished containers 31 are evacuated by sliding along a suitably inclined chute 41. The passages of the receptacles 20 are dimensioned and configurated in such a way that they permit the deformed blanks 100 as well as the tools 21 and 22 to pass therethrough (see FIG. 8 wherein the major part of the upper tool 21 and a portion of the lower tool 22, as well as the major part of the deformed blank 100, i.e., partially completed container 31 are located in the passage of the respective receptacle 20).

Figure 10:
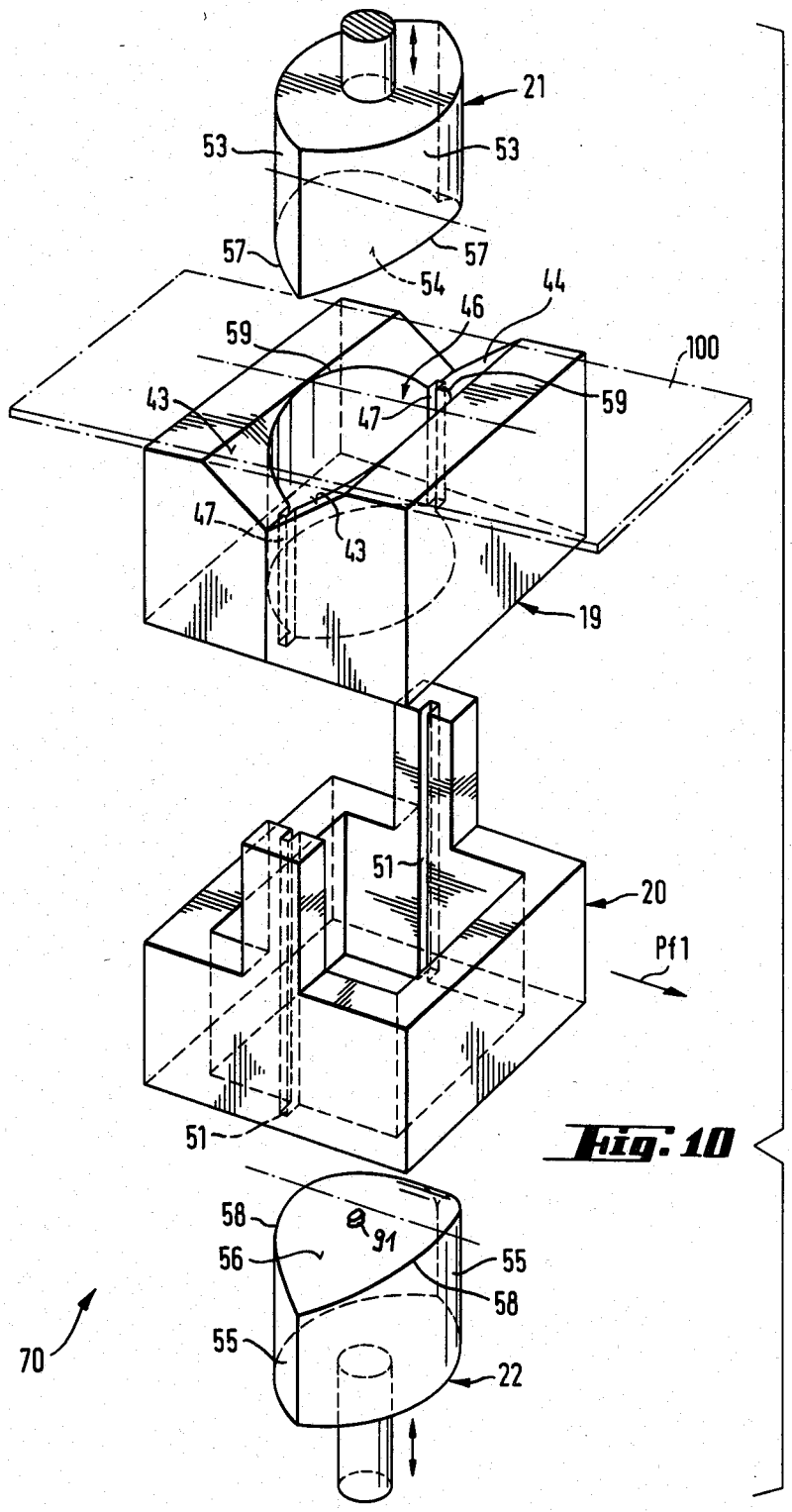
FIG. 10 is an enlarged exploded perspective view of the blank converting unit and of one receptacle of the transporting means, the tools being shown in the positions corresponding to those of FIG. 5 or 9 and a blank being indicated by phantom lines at a level between the matrix and the upper tool.

FIG. 10 shows that the cavity 46 of the matrix 19, the upper tool 21 and the lower tool 22 have lenticular cross-sectional outlines which match or closely approximate the outline of the centrally located first portion 6' of a blank 100. That end of the cavity 46 which faces the concave surface 54 at the underside of the upper tool 21 (when the latter is held in the first end position of FIG. 10) is bounded by an edge consisting of two mirror symmetrical arcuate sections 59 which define two acute angles located in the deepmost portion of a transversely extending elongated V-shaped recess or notch 44 which is machined into or otherwise formed in the upper end face of the fixed matrix 19. The recess 44 is bounded by two flat or substantially flat folding surfaces 43 which make an angle of 90 degrees (this angle can be different if the shape of the container 31 is to deviate appreciably from the illustrated shape). The concave surface 54 at the underside of the tool 21 is complementary to the convex surface 56 at the top of the lower tool 22 and is identical with the concave outer side of the end wall 6 of a container 31. In other words, when the first portion 6' of a blank 100 is placed between the tools 21, 22 and one of these tools is moved toward the other tool, the surfaces 54 and 56 act upon the respective sides of the portion 6' and convert it into the end wall 6.

Figures 5, 6, 7, 8, 9:
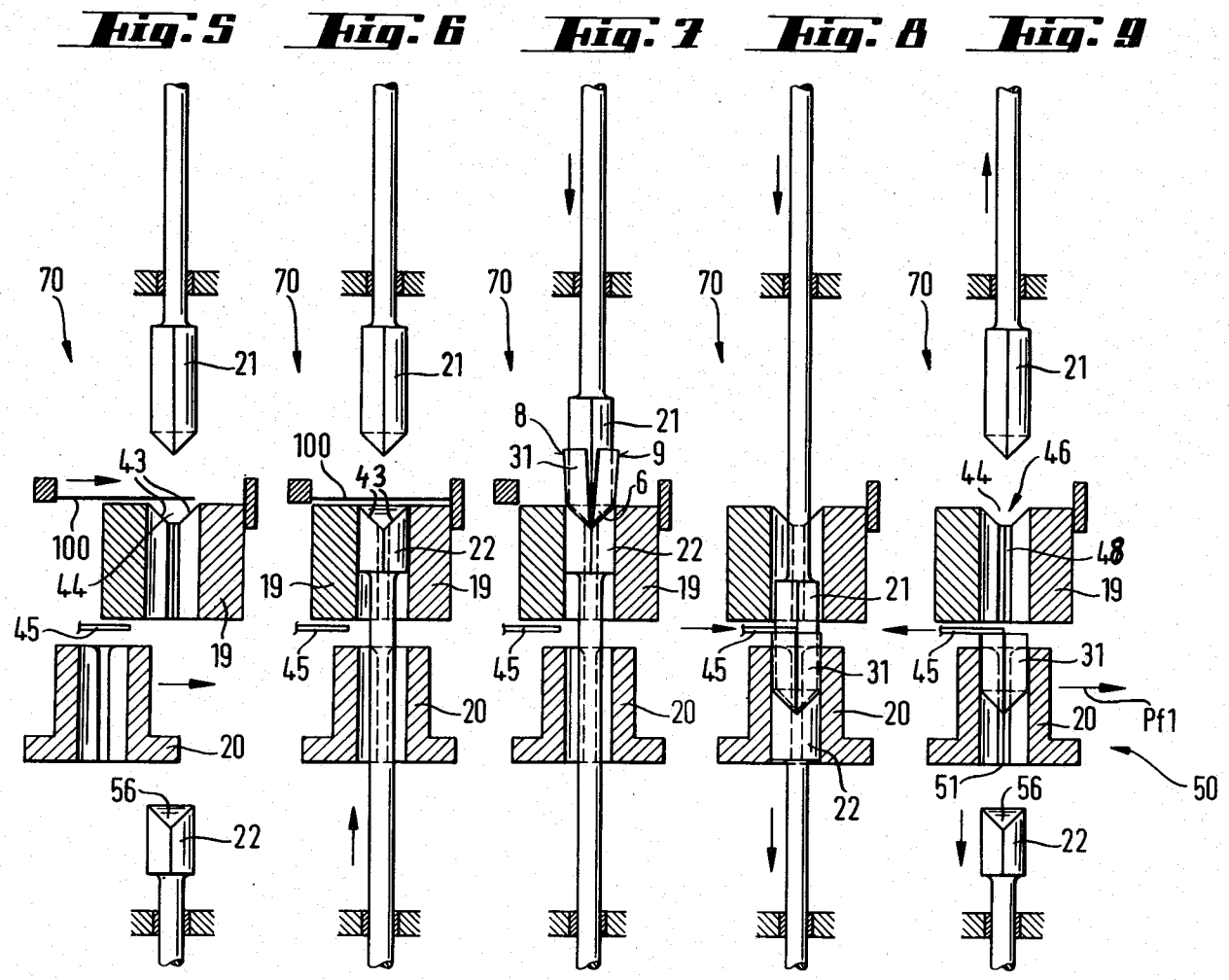
FIG. 5 is an enlarged vertical sectional view of the blank converting unit in the apparatus of FIG. 4, with the two tools of the converting unit respectively shown in their first and second end positions.
FIG. 6 shows the structure of FIG. 5 but with the lower tool in the first end position.
FIG. 7 illustrates the structure of FIG. 6 but with the upper tool on its way toward the second end position and with a blank partially draped around the upper tool.
FIG. 8 shows the structure of FIG. 7, with the deformed blank located in the cavity of the matrix.
FIG. 9 shows the structure of FIG. 8 with the deformed blank introduced into one receptacle of the transporting means and with the tools returned to the positions of FIG. 5.

The position and depth of the recess 44 are selected in such a way that, when a partially deformed blank 100 assumes the position of FIG. 7, the apices 3 and 4 of the deformed first portion 6' (end wall 6) are located in the deepmost portion of the recess 44. The matrix 19 is formed with two parallel upright grooves 48 which communicate with the adjacent narrowest portions of the cavity 46 (in the regions where the arcuate sections 59 of the edge at the upper end of the cavity 46 make the aforediscussed acute angles) and receive the apices 3, 4 of the end wall 6 when the partially deformed blank is caused to penetrate into the cavity 46 (on its way from the position of FIG. 7 toward the position of FIG. 8). The grooves 48 further receive the longitudinally extending marginal portions 10 and 11 of the deformed (flexed and curved) outer portions 8', 9' of the blank which is in the process of moving through the cavity 46 to the lower end position of FIG. 8, i.e., into the passage of the registering receptacle 20. The upper end portions or inlets of the grooves 48 are denoted by the characters 47.

The sections 59 of the edge at the upper end of the cavity 46 match the boundaries 1 and 2 between the end wall 6 and the sidewalls 8, 9 of a container 31, and the same holds true for the two mirror symmetrical sections 57 surrounding the concave surface 54 of the upper tool 21 as well as the mirror symmetrical sections 58 surrounding the convex surface 56 of the lower tool 22. The boundaries 1 and 2 between the end wall 6 and the sidewalls 8, 9 of a container 31 are formed by the sections 59 of the edge on the matrix 19 jointly with the sections 57 of the edge on the tool 21 and the sections 58 of the edge on the tool 22 when the tool 22 is initially held in the upper or first end position shown in FIGS. 6 and 7 and the moving means 121 causes the upper tool 21 to descend from the upper or first end position of FIGS. 5 and 6 toward and downwardly beyond the intermediate position of FIG. 7. In FIGS. 6 and 7, the two sections 58 of the edge surrounding the convex surface 56 of the lower tool 22 are immediately adjacent to the corresponding sections 59 of the edge at the upper end of the cavity 46 in the matrix 19. The curvature and length of the sections 57 are identical or practically identical with the curvature and length of the corresponding sections 59 and 58 (this can be readily seen in FIG. 10 as well as in FIGS. 11, 12 and 13). As mentioned above, the three edges cooperate to provide the blanks 100 with boundaries 1, 2 which delimit the respective end walls 6 and can be said to constitute fold lines between the end wall 6 and the respective sidewalls 8, 9 of a finished or partly finished container 31.

The first step in conversion of a blank 100 into a container 31 involves a movement of the upper tool 21 to its first or upper end position (as shown in FIG. 4 and in FIGS. 5, 6, 9 and 10) while the lower tool 22 dwells in or is on its way toward or from the lower end position of FIG. 5. This enables the conveyor 16 and one of its pushers 17 to advance the foremost blank 100 in a direction to the right and against a suitable stop 19*a* extending upwardly beyond the upper side of the matrix 19. The corresponding pusher 17 is then pivoted in a plane at right angles to the plane of FIG. 4 or 6. The stop 19*a* maintains the blank 100 in an optimum position in which the first portion 6′ of such blank overlies the upper end of the cavity 46 in the matrix 19. At such time, the lower tool 22 is located in the upper or first end position of FIG. 6 in which the sections 58 of its edge are adjacent to the respective sections 59 of the edge at the upper end of the matrix 19. The parts 19 and 22 then constitute a female mold which is ready to cooperate with the male mold (tool) 21. The actual conversion of the blank 100 which has been placed on top of the matrix 19 into a partially finished container 31 can be best seen by looking at FIGS. 7, 8 and 9. Thus, the concave surface 54 of the descending tool 21 engages the exposed side of the first portion 6′ of the blank 100 and urges the other side of the first portion 6′ against the convex surface 56 of the tool 22. This results in conversion of the portion 6′ into the end wall 6 of the container and, at the same time, the surfaces 43 bounding the recess 44 of the matrix 19 fold the outer portions 8′, 9′ of the blank upwardly and along the sides of the descending tool 21. Folding of the outer portions 8′, 9′ takes place exactly along the boundaries 1 and 2 between the end wall 6 and the incipient sidewalls 8, 9 of the resulting partially finished container 31.

The tools 21, 22 thereupon move as a unit from the positions of FIG. 7 toward the positions of FIG. 8 whereby the container 31 penetrates into and moves downwardly through and beyond the cavity 46 of the stationary matrix 19. The material of the blank 100 cannot change its position because the finished end wall 6 continues to be clamped between the surfaces 54 and 56 of the descending tools. As can be ascertained from a comparison of FIGS. 7 and 8, penetration of the material of the blank 100 deeper into the cavity 46 results in further folding of the developing sidewalls 8 and 9 toward each other.

The container 31 enters the passage of the registering receptacle 20 below the matrix 19 when the upper tool 21 reaches the second or lower end position of FIG. 8. A mobile stop 45 is then moved above the transverse marginal portions 12 of the sidewalls 8, 9 so that the tool 21 can be lifted back to its first or upper end position but the container 31 is compelled to remain in the passage of the corresponding receptacle 20. The lower tool 22 is caused to move to the second or lower end position of FIG. 9 and the upper tool 21 is lifted to the first or upper end position of FIG. 9. This enables the receptacle 20 to advance the container 31 to the next station, i.e., to a position of register with the unit 71. Actually, the transporting device 50 can set the receptacles 20 in motion as soon as the tool 22 descends to a level below the receptacle 20 and the tool 21 rises to a level above the stop 45 which is thereupon retracted because the container 31 is or can be held in the passage of the respective receptacle 20 by friction.

As mentioned above, the first or upper end position of the lower tool 22 is preferably that which is shown in FIGS. 6 and 7, i.e., in which the sections 58 of the edge bounding the convex surface 56 are immediately adjacent to the respective sections 59 of the edge bounding the upper end of the cavity 46 in the matrix 19. At such time, the upper tool 21 dwells in or is on its way downwardly from the upper end position of FIGS. 5 and 6. In order to speed up the making of successive containers 31, the lower tool 22 can be on its way to the upper end position of FIG. 6 while the upper tool 21 is on its way to the intermediate position of FIG. 7, as long as the conveyor 16 is afforded the necessary time to advance a fresh blank 100 onto the matrix 19 before the upper side of such blank is contacted by the descending tool 21. The means for imparting movements to the moving means 121, 122 for the respective tools 21, 22 is not specifically shown in the drawing; such movement imparting means can comprise a system of cams cooperating with follower means at the upper end of the moving means 121 and the lower end of the moving means 122. The tool 21 can push the lower tool 22 downwardly during movement from the intermediate position of FIG. 7 to the lower end position of FIG. 8; this ensures that the end wall 6 is adequately clamped between the surfaces 54 and 56, especially if the downward movement of the tool 22 under the action of the descending tool 21 is opposed by one or more springs or the like. The return strokes of the tools 21 and 22 to their respective upper and lower end positions can be completed very rapidly in order to shorten the intervals which are required for the making of successive containers 31.

Instead of being secured to a chain (arrow Pf1), the receptacles 20 of the transporting device 50 can be mounted on a turntable which is indexed at required intervals in order to advance successive receptacles 20 to the stations 70, 71, 72, 73 and, if necessary to one or more additional stations before the receptacles return into register with the matrix 19. In either event, the receptacles 20 are preferably movable at right angles to the direction of reciprocatory movement of the tools 21 and 22.

It has been found that the improved apparatus can properly treat blanks consisting of a semirigid material, such as laminated cardboard, which is not ductile and which cannot be stretched. Conversion of the first portions 6′ of blanks 100 into concavo-convex end walls 6 and the conversion of outer portions 8′, 9′ of blanks 100 into concavo-convex sidewalls 8, 9 takes place without any breakage of the semirigid material along the boundaries 1 and 2, i.e., the stretching and compressive stresses in the regions of the boundaries 1, 2 need not be so pronounced that the material of the blanks would undergo destruction at the locations where the sidewalls 8, 9 join the end wall 6 in spite of the fact that the surfaces 54 and 56 of the tools 21, 22 exert against the respective sides of each first portion 6′ a pressure which is amply sufficient to convert such portion into a properly shaped end wall 6 having a concave outer side. It is often desirable to slightly bevel the tools 21, 22 and the matrix 19 in the regions of the edges including the respective pairs of arcuate sections 57, 58 and 59 in order to even further reduce the likelihood of damage to the material of the blanks 100 during conversion of such blanks into partially finished containers 31.

Figure 14:
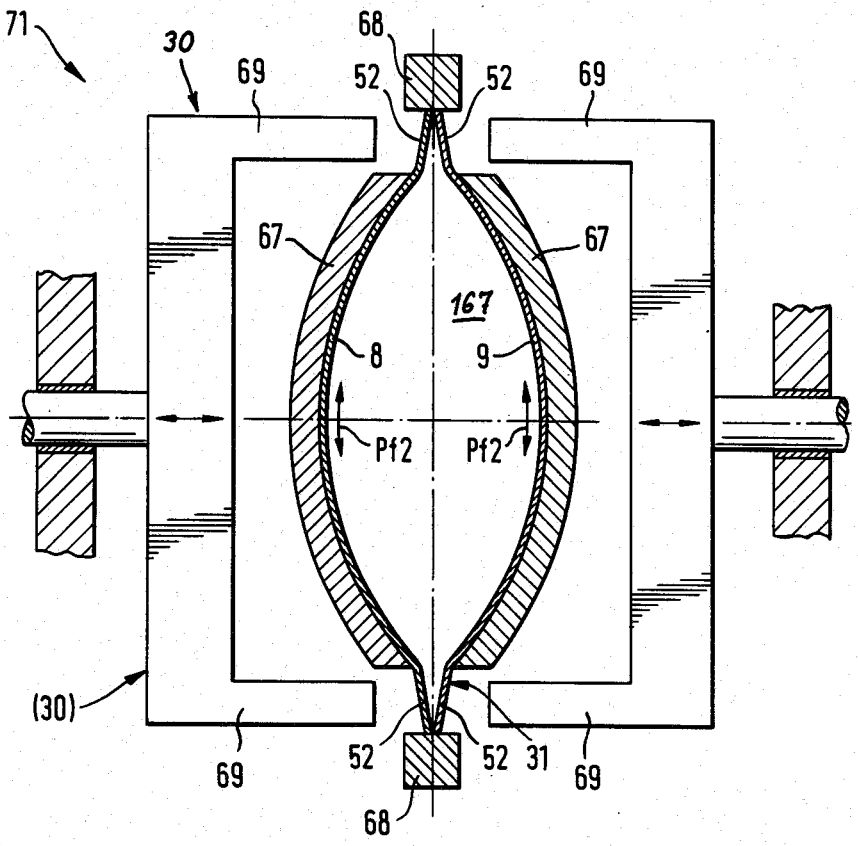
FIG. 14 is an enlarged horizontal sectional view as seen in the direction of arrows from the line A—A of FIG. 4.

The container 31 which reaches the position of FIG. 9 (in the passage of the respective receptacle 20) is then advanced by a step to a position of register with the bonding unit 71 of FIG. 4. The container 31 is transferred from its receptacle 20 by two cooperating pushers 27, 28 (which can constitute or resemble shortened versions of the tools 21 and 22) so that the container assumes the position of FIG. 4, namely at a level above the respective receptacle 20 and between two jaws 30 of a heat-sealing device whose function is to bond the longitudinally extending marginal portions 10, 11 of the sidewall 8 to the corresponding longitudinally extending marginal portions of the sidewall 9 in order to partially seal the container 31 preparatory to admission into its interior of a supply of filler material at the station for the unit 72. The bonding unit 71 may be constructed in a manner as shown in FIG. 14.

The pushers 27, 28 thereupon return the container 31 from the space between the jaws 30 into the passage of the registering receptacle 20 before the transporting device 50 is set in motion again to advance the receptacle 20 and the container 31 therein to the station for the filling unit 72. A pusher 34 lifts the container 31 out of the receptacle 20 and to the position of FIG. 4 so that the opening 95 between the still unsealed transverse marginal portions 12 of the sidewalls 8 and 9 is located immediately or closely below the outlet of a device 32 which serves to introduce filler material into the interior of the container 31 (it is clear that the aperture 90 of the container is sealed at such time, e.g., by the aforediscussed nipple which is inserted into the aperture in any conveniently accessible portion of the path which is defined by the transporting device 50).

When the admission of filler material is completed, the introducing device 32 is moved out of the way and is replaced by a pusher 35 which can shift the filled container downwardly. The pusher 35 is optional since the receptacle 20 containing the freshly filled container 31 can advance to the next station (for the unit 73) even if it remains at the level which is shown below the material introducing device 32 of FIG. 4.

At the station for the unit 73, a pusher 38 is caused to descend and to expel the filled container 31 from its receptacle 20 onto a retractible support 39 which is engaged by the concave outer side of the end wall 6 so that the transverse marginal portions 12 of the sidewalls 8, 9 of the filled receptacle 31 are located between the jaws 40 of a sealing or bonding device serving to complete the sealing of the container 31. The support 39 is thereupon retracted or otherwise moved out of the way so that the filled and sealed container 31 can descend into the chute 41 which delivers it to a collecting station or to another destination.

FIG. 10 shows a blank 100 by phantom lines in a position in which its outer portions 8' and 9' overlie the upper side of the matrix 19 at the opposite sides of the V-shaped recess 44. As mentioned above, the folding surfaces 43 flanking the recess 44 can make an angle of approximately 90 degrees. These surfaces ensure a predictable conversion of the outer portions 8', 9' into sidewalls 8 and 9 of a partially finished container 31 as soon as the upper tool 21 begins to penetrate into the cavity 46. At such time, the longitudinally extending marginal portions 10, 11 of the developing sidewalls 8, 9 are caused to slide in the respective grooves 48 of the matrix 19. The receptacles 20 are preferably provided with grooves 51 which register with the grooves 48 of the matrix 19 whenever a receptacle 20 assumes the position of FIG. 10 (in which the passage of such receptacle is aligned with the cavity 46 and with the tools 21 and 22). The purpose of the grooves 51 (and more particularly of the surfaces surrounding such grooves) is to prevent expansion or opening up of the partially finished container 31 which is being transported from the blank converting unit 70 to the unit 71. It is advisable to provide the matrix 19 and each receptacle 20 with rounded surfaces (not specifically shown) which bound the upper ends 47 of the grooves 48 and the upper ends of the grooves 51 so as to facilitate entry of the lowermost parts of longitudinal marginal portions 10, 11 of the sidewalls 8, 9 first into the grooves 48 of the matrix 19 and thereupon into the corresponding grooves 51 of the receptacle 20 below the matrix.

As mentioned above, the configuration and length of the sections 57 of the edge on the upper tool 21 are the same or nearly identical with those of the corresponding sections 58 of the edge on the lower tool 22 and the corresponding sections 59 of the edge at the upper end of the cavity 46 in the matrix 19. The manner in which such edges, and also the surfaces bounding the cavity 46 as well as the peripheral surfaces of the tools 21 and 22 are formed is illustrated in FIGS. 11 to 13. These Figures show two imaginary cylindrical surfaces 62 and 63 whose axes are parallel and which partially overlap each other so that the arcuate portion 66 of the imaginary cylindrical surface 62 has a curvature matching that of the boundary 1 and the curvature of the sidewall 8 in the region where such sidewall is integral with the end wall 6 of a container 31, and so that the arcuate portion 66 of the imaginary cylindrical surface 63 has a curvature matching that of the boundary 2 and of the outline of the sidewall 9 in the region where this sidewall is integral with the end wall 6. The diameters of the cylinders 62, 63 are the same, i.e., the curvature of the boundary 1 matches that of the boundary 2. The distance between the axes of the cylinders 62, 63 is less than the diameter of one of these cylinders.

A further imaginary clindrical surface 65 extends at right angles to and intersects the cylindrical surfaces 62, 63 in a manner best shown in FIG. 12. The radius of the surface 65 is identical with the radii of the surfaces 62, 63 and matches the radius of curvature of the exposed concave side of the end wall 6 of a container 31. The axis of the cylinder 65 is located in the common plane of the axes of the cylinders 62 and 63. The radii of curvature of the surfaces 54 and 56 match or closely approximate the radius of the cylinder 65. The radii of curvature of the convex halves 53 of the peripheral surface of the upper tool 21 and of the convex halves 55 of the peripheral surface of the lower tool 22 also match the radius of the cylinder 62, 63 or 65.

FIG. 14 shows the details of the presently preferred bonding unit 71. Each of the jaws 30 is a substantially U-shaped body with two prongs or arms 69 which can engage the marginal portions 10, 11 of the sidewalls 8, 9 while such sidewalls are disposed in the chamber 167 of a two-piece receptacle 67. The concave inner sides of the two parts of the receptacle 67 allow the respective sidewalls 8, 9 of the container 31 to move in the directions indicated by double-headed arrows Pf2 so as to move the lateral edge faces into contact with the respective stationary guide means 68 of the unit 71. This ensures that the longitudinally extending marginal portions 10, 11 of the sidewall 8 in the chamber 167 are accurately aligned with the corresponding marginal portions 10, 11 of the sidewall 9 before the arms 69 of the jaws 30 are caused to move toward each other and to bond such marginal portions to each other.

Instead of heating the jaws 30, it is also possible to use these jaws as component parts of an ultrasonic welding device or a high-frequency welding (electronic sewing) device. The arms or prongs 69 of the jaws 30 can extend into the spaces between the adjacent end portions of the receptacle 67 and the corresponding guide means 68.

The guide means 68 cooperate with the concave inner sides of the receptacle 67 to ensure accurate alignment of the marginal portions 10, 11 of the sidewall 8 with the marginal portions 10, 11 of the sidewall 9 in the chamber 167 before the actual sealing or bonding action begins. The provision of such guide means obviates the need for the provision of a trimming unit which would be necessary to enhance the appearance of the finished container 31 if the marginal portions 10, 11 of the sidewall 8 were not in accurate alignment with the marginal portions 10, 11 of the sidewall 9 at the time these marginal portions are bonded to each other as a result of the application of heat or in any other suitable way.

The apparatus 101 can include one or more additional container-treating units which are adjacent to the path of movement of the receptacles 20. For example, the apparatus can include a cleaning and/or sterilizing unit for containers 31, a unit which inserts nipples into or applies caps to the apertures 90 of successive containers 31 (for example, at a station between the units 70, 71 or 71, 72), a unit which is equipped with means for monitoring the shape and/or other characteristics of successive containers 31 prior to and/or after filling, a unit which attaches a pamphlet to each finished container 31, a unit which attaches a bottom wall to each container 31 and/or any other unit which might be necessary in connection with the making of containers, introduction of material into the containers, inspection of containers, identification of the contents of the containers and/or other information which must be applied or attached to the containers. The number and/or nature of various units will depend on a number of factors, such as the nature of the contents of the containers and the rules and regulations in a particular country, state or other administrative entity. The various units can be installed at a level above and/or below the path of receptacles 20. As can be seen in FIG. 4, the units 70, 71 and 72 are located at a level above and the unit 73 is located at a level below the path of receptacles 20 forming part of the transporting device 50. The device 50 can comprise a single receptacle 20 or a series of interconnected or independently movable receptacles, depending on the desired output of the apparatus. As already mentioned above, the receptacles 20 can be mounted on an indexible turntable.

It is further possible to modify the blank converting unit 70 in such a way that the boundaries 1 and 2 between the end wall 6 and the sidewalls 8, 9 of each receptacle will not be arcuate but polygonal, preferably consisting of a series of at least substantially straight facets. This necessitates corresponding modifications in the configuration of edges and peripheral surfaces of the two tools in the blank converting unit 70 as well as appropriate changes in the configuration of the edge at the upper end of the cavity in the matrix and in the configuration of the surface bounding the cavity.

An important advantage of the improved method and apparatus is that the making of the end wall 6 takes place simultaneously with or even precedes the folding of the outer portions 8', 9' of the blanks 100 which takes place not later than in response to introduction of the freshly formed end wall 6 into the cavity 46 of the matrix 19. This is in contrast to prior proposals which involve the introduction of a blank into the cavity of a matrix for the purpose of forming the sidewalls prior to conversion of a portion of the blank into an end wall or bottom wall. Consequently, the boundaries 1 and 2 are formed at the time of forming the end wall 6 which is desirable and advantageous because the possibility or likelihood of deforming the blank in regions other than those corresponding to the locations of the boundaries 1 and 2 is eliminated in an extremely simple but highly effective way. As a rule, the outer portions 8' and 9' of the blank 100 begin to move toward each other in immediate response to engagement of the centrally located first portion 6' by the concave surface 54 of the upper tool 21, and such movement of the outer portions 8', 9' toward each other (along the respective halves 53 of the peripheral surface of the tool 21) continues with progressing penetration of the tool 21 into the recess 44 and cavity 46. The improved method and apparatus further ensure that a container 31 can be completed within a short interval of time because, save for the bonding of the marginal portions 10, 11 of the sidewall 8 to the corresponding marginal portions of the sidewall 9, the container 31 is completed almost immediately after the tool 21 begins to enter the cavity 46. Thus, the end wall 6 is completed in the first step and the movements of outer portions 8', 9' of the blank 100 toward each other begin at the time of or even prior to completion of conversion of the first portion 6' into the end wall 6. Still further, the improved method and apparatus ensure that the orientation of the blank 100 cannot change as soon as the first portion 6' is converted into the end wall 6 because the tools 21, 22 continue to clamp the blank therebetween and, furthermore, the matrix 19 as well as the receptacles 20 of the transporting device 50 (and even the bonding unit 71) are or can be provided with the aforediscussed guide means (surfaces bounding the grooves 48 and 51 and the elements 68) which render it unnecessary to trim or similarly treat a container which issues from the last unit 73. The placing of successive receptacles 20 in exact register with the cavity 46 of the fixed matrix 19 for reception of freshly converted blanks 100 (partly finished containers 31) exhibits the advantage that the tools 21 and 22 need not interrupt their downward movement (which is necessary to cause the blank 100 to enter the cavity 46) in order to transfer the freshly obtained container 31 into the passage of the receptacle 20 below the matrix 19. This shortens the intervals which are necessary for the making of containers.

The provision of the aperture 90 in the first portion 6' of each blank 100 is often desirable because such aperture can receive a closure or a nipple and it can also serve as a means for facilitating centering of the blanks 100 during transport through the cavity 46 of the matrix 19. As can be seen in FIG. 10, the convex surface 56 of the lower tool 22 can be provided with a protuberance 91 which enters the aperture 90 of the blank 100 overlying the upper side of the matrix 19 before the upper tool 21 reaches the position of FIG. 7 so that the blank 100 cannot be shifted as a result of initial contact with the concave surface 54 of the tool 21. Such concave surface is then provided with a recess (not specifically shown) which receives the protuberance 91 of the lower tool 22 while the two tools descend as a unit from the positions of FIG. 7 to those shown in FIG. 8. Reference may also be had to the aforementioned commonly owned European Pat. No. 0 041 924 and to the corresponding U.S. Pat. No. 4,394,936 which show containers with apertured end walls and nipples inserted into such apertures. The nipple can be inserted into the aperture prior or subsequent to conversion of the blank into a container. All in all, the aperture 90 and/or a nipple in such aperture facilitates the centering of the respective blank and thus further reduces the likelihood of the need for trimming of the finished container.

The improved apparatus can comprise two or more blank converting units 70 and a discrete bonding unit 71, filling unit 72 and sealing unit 73 for each blank converting unit. The surfaces 43 need not be continuous, i.e., they can include a plurality of relatively small portions as long as they can properly fold the outer portions 8' and 9' of a descending blank 100 so that such outer portions are converted into the sidewalls 8 and 9 of the developing container 31. The feature that the edges of the tools 21, 22 cooperate with the edge of the matrix 19 at the very start of the converting operation ensures that the boundaries 1 and 2 are defined with the required degree of definiteness as soon as the blank 100 overlying the matrix 19 begins to undergo deformation. This, in turn, ensures that penetration of the blank into the cavity 46 of the matrix 19 does not result in the making of additional boundaries which could unduly weaken or adversely affect the appearance of the product. Absence of additional fold lines (namely, of fold lines in addition to those constituting the boundaries 1 and 2) is desirable on the additional ground that the making of a minimum number of fold lines or boundaries contributes significantly to the stability of that portion of the finished container which includes the neighboring parts of the sidewall 8 and end wall 6 on the one hand and the neighboring parts of the sidewall 9 and the end wall 6 on the other hand.

The feature that the upper tool 21 has a concave surface 54 and the matrix 19 is formed with the transversely extending recess 44 is desirable and advantageous on the additional ground that the two narrowest portions of the surface 54 can extend into the deepmost portion of the recess 44 whereas the median portion of the surface 54 arches from the one narrowest portion toward the other narrowest portion. This ensures the making of predictable boundaries 1 and 2 between the freshly formed end wall 6 and the adjacent portions 8', 9' of the respective blank 100 at the very onset of conversion of such blank into a container.

The shaping of the blank-contacting front surfaces and peripheral surfaces of the tools 21, 22 and of the internal surface of the matrix 19 in a manner as described with reference to FIGS. 11 to 13 is desirable and advantageous because it contributes to simplicity of the tools and matrix as well as to lower manufacturing cost. Moreover, the containers which are formed by such tools in cooperation with the matrix 19 have an eye-pleasing appearance with a neatly arched end wall 6 and neatly arched sidewalls 8, 9.

An additional advantage of the improved apparatus is that the tools 21, 22 of the unit 70 as well as the various pushers and other tools of the additional units can be moved by relatively simple and inexpensive means, such as cams and followers, rack and pinion drives or the like. The speed of the tools 21, 22 need not be constant, i.e., certain stages of their upward and/or downward movement can be carried out at a higher speed than the remaining stages in order to further increase the output of the improved apparatus. One of the additional units can constitute an evacuating unit, e.g., a unit which can evacuate air or a previously admitted filler material from the interior of successive containers.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of making a container, comprising the steps of positioning a cavity and complementary first and second deforming surfaces in a predetermined relationship, said cavity having at least one open end, and said one end being provided with a first shaping edge, said second deforming surface being bounded by a second shaping edge which substantially matches said first shaping edge, and the positioning step including moving said second deforming surface and said cavity relative to one another to position said second deforming surface within the outline of said cavity such that said second shaping edge is at least approximately in register with said first shaping edge, the positioning step further including moving said deforming surfaces relative to one another so that said deforming surfaces define a gap; placing a deformable sheet-like blank in said gap so that a first portion of said blank, which is flanked by two outer portions of said blank, is located between said deforming surfaces; converting said first blank portion into an end wall of said container by moving said deforming surfaces relative to and towards one another until said first blank portion is clamped by said deforming surfaces, the converting step including maintaining registry between said shaping edges until said first blank portion is clamped by said deforming surfaces so that said shaping edges define a boundary of said end wall upon clamping of said first blank portion by said deforming surfaces; and folding said outer blank portions along said boundary to transform said outer blank portions into sidewalls of said container.

2. The method of claim 1, wherein the outer portions of the blank are folded along the first deforming surface.

3. The method of claim 1, further comprising the steps of expelling the blank from the cavity including moving the blank along a substantially straight path with the end wall leading, and thereupon transporting the blank sideways.

4. The method of claim 1, further comprising the step of providing the first portion of the blank with an aperture prior to said converting step.

5. The method of claim 4, further comprising the step of centering the blank with reference to the deforming surfaces through the medium of the aperture in the first portion thereof.

6. The method of claim 1, wherein the blank is flat prior to said converting step; and further comprising the steps of establishing a source of discrete blanks and advancing successive discrete blanks from the source between the deforming surfaces.

7. The method of claim 1, further comprising the steps of establishing a series of coherent blanks, separating successive blanks from the remaining blanks of the series, and advancing the separated blanks between the deforming surfaces.

8. The method of claim 1, further comprising the step of bonding the marginal portions of one of the sidewalls to the corresponding marginal portions of the other of the sidewalls.

9. The method of claim 8, wherein said bonding step includes the application of heat.

10. The method of claim 8, wherein said bonding step includes ultrasonically welding the marginal portions of the sidewalls to each other.

11. The method of claim 8, wherein said bonding step includes electronic sewing.

12. The method of claim 8, wherein said bonding step includes sealingly securing some of the marginal portions of the sidewalls to each other in a first step and sealingly securing the remaining marginal portions of the sidewalls to each other in a subsequent second step.

13. The method of claim 12, wherein the remaining marginal portions of the sidewalls define an opening subsequent to said first but prior to said second securing step; and further comprising the step of filling the container by way of said opening prior to said second securing step.

14. The method of claim 1, wherein said blank is semirigid.

15. The method of claim 14, wherein said blank comprises laminated cardboard.

16. The method of claim 1, wherein the folding step comprises moving said cavity and said deforming surfaces relative to one antoher while continuing to clamp said first blank portion between said deforming surfaces so that said outer blank portions penetrate into said cavity.

17. The method of claim 1, wherein the folding dtep comprises forming said sidewalls with at least partly convex outer sides.

18. The method of claim 1, wherein at least parts of the folding step is performed during the converting step.

19.The method of claim 1, wherein the converting step comprises forming said end wall with a concave outer side.

20. The method of claim 1, wherein the positioning step comprises moving said first and second deforming surfaces while maintaining said cavity stationary.

21. The method of claim 1, wherein the converting step comprises moving said first deforming surface while maintaining said second deforming surface and said cavity stationary.

22. The method of claim 1, wherein the folding step comprises moving said deforming surfaces while maintaining said cavity stationary.

23. The method of claim 1, said cavity having another open end opposite said one end; and wherein the positioning step comprises introducing said second deforming surface into said cavity via said other end.

24. The method of claim 1, said first deforming surface being bounded by an additional shaping edge complementary to said second shaping edge; and wherein said additional shaping edge cooperates with said first and second shaping edges to define said boundary.

25. The apparatus of claim 1, wherein said matrix is fixed.

26. Apparatus for making a container from a deformable sheet-like blank, particularly a semirigid blank such as a blank of laminated cardboard, comprising a blank converting unit including a first tool having a first deforming surface, a second tool having a second deforming surface complementary to said first deforming surface, and a matrix defining a cavity having at least one open end and designed to receive said second tool, said one end being provided with a first shaping edge, and said second deforming surface being bounded by a second shaping edge which substantially matches said first shaping edge; and moving means arranged to: (i) position said tools and said matrix relative to one another such that said second tool is in said cavity with said second shaping edge at least approximately in register with said first shaping edge, and such that said tools define a gap for insertion of a blank between said deforming surfaces, and (ii) move said tools relative to and towards one another while maintaining registry between said shaping edges until said tools assume a relative position in which a blank can be clamped by said deforming surfaces.

27. The apparatus of claim 26, wherein said first deforming surface is bounded by an additional shaping edge complementary to said second shaping edge.

28. The apparatus of claim 27, wherein said moving means includes means for moving said first tool between a first position in which the edge of the first tool is remote from the edge of said matrix so that a blank can be placed between the matrix and said first tool in a position such that a first portion of the blank overlies the one end of said cavity and a second position in which the first tool extends into said cavity whereby the first tool advances the first portion of the blank which overlies the one end of the cavity into the interior of said matrix, said moving means further comprising means for moving said second tool between a first position in which the edge of the second tool is adjacent to the edge of said matrix and a second position in response to penetration of the first tool into said cavity.

29. The apparatus of claim 28, wherein said matrix has a pair of folding surfaces adjacent to said edge thereof and arranged to fold the outer portions of a blank held between the surfaces of said first and second tools while said first tool penetrates into said cavity whereby the outer portions of such blank extend along the periphery of said first tool.

30. The apparatus of claim 28, wherein said tools are coaxial with one another and said means for moving said first tool is arranged to displace said second tool from the first position of said second tool during movement of said first tool from the first to the second position thereof, the deforming surface of said first tool and the entire deformed blank being located outside of said cavity in the second position of said first tool so that the thus expelled deformed blank can be transported away from a position of register with said cavity and said tools.

31. The apparatus of claim 26, wherein said moving means comprises means for expelling deformed blanks from said cavity through the medium of one of said tools; and further comprising a bonding unit, and means for transporting the expelled blanks from said converting unit to said bonding unit, said bonding unit comprising a pair of jaws arranged to clamp the marginal portions of a deformed blank to each other.

32. The apparatus of claim 31, wherein said bonding unit further comprises a pair of guide means for the marginal portions of deformed blanks, and a receptacle having a chamber whose outline matches or approximates that of a deformed blank and which receives deformed blanks during bonding of the marginal portions of such blanks to each other.

33. The apparatus of claim 26, wherein said matrix has an end face adjacent said one end of said cavity and a transversely extending substantially V-shaped recess in said end face, said moving means including means for moving said second tool to a predetermined position in which the deforming surface of said second tool is located in said recess.

34. The apparatus of claim 33, wherein said recess is bounded by two surfaces making an angle of substantially 90 degrees.

35. The apparatus of claim 26, wherein said cavity and said tools have substantially lenticular cross-sectional outlines.

36. The apparatus of claim 35, wherein each of said edges includes two substantially arcuate sections which make two acute angles with one another, said matrix having an elongated substantially V-shaped transverse recess adjacent said one end of said cavity, and the acute angles defined by the arcuate sections of the edges of said matrix being located in the deepmost portion of said recess.

37. The apparatus of claim 26, wherein said cavity has a substantially lenticular cross-sectional outline with two narrowest portions located opposite and spaced apart from each other, said matrix having two parallel grooves communicating with the narrowest portions of said cavity and arranged to receive the marginal portions of a blank held between said tools.

38. The apparatus of claim 37, wherein said matrix has internal surfaces bounding said grooves and arranged to guide the respective marginal portions.

39. The apparatus of claim 27, wherein the edges of said tools and of said matrix have polygonal outlines with at least substantially straight facets.

40. The apparatus of claim 26, wherein said moving means is further arranged to move said matrix and said tools relative to one another while maintaining said relative position of said tools so that said deforming surfaces penetrate into said cavity.

41. The apparatus of claim 26, said cavity having another open end opposite said one end; and wherein said moving means is arranged to bring said first and second shaping edges into register with one another by effecting introduction of said second tool into said cavity via said other end.

42. The apparatus of claim 41, further comprising means for transporting at least partially finished containers away from said unit, including at least one receptacle adjacent to the other end of said cavity and arranged to receive a deformed blank from said matrix in response to expulsion of such deformed blank by one of said tools, and means for conveying said receptacle substantially transversely of said cavity.

43. The apparatus of claim 42, wherein said conveying means includes means for conveying said receptacle stepwise along a predetermined path; and further comprising at least one additional unit adjacent to said predetermined path and having means for treating the deformed blank which is delivered thereto by said receptacle.

44. The apparatus of claim 43, wherein said additional unit includes means for bonding the marginal portions of deformed blanks to each other.

45. The apparatus of claim 43, wherein said additional unit includes means for introducing a filler material into the interior of the deformed blanks.

46. The apparatus of claim 26, wherein one of said deforming surfaces is concave and the other of said deforming surfaces is convex.

47. The apparatus of claim 46, wherein said concave and convex surfaces constitute portions of cylindrical surfaces.

48. The apparatus of claim 46, wherein each of said tools has a peripheral surface composed of two mirror symmetrical convex halves and the radius of curvature of each of said convex halves matches the radii of curvature of said concave and convex surfaces.

49. The apparatus of claim 46, wherein said first deforming surface is concave and said second deforming surface is convex.

50. The apparatus of claim 26, wherein said cavity is bounded by a pair of concave surface segments.

51. The apparatus of claim 46, wherein said matrix has an internal surface surrounding said cavity and consisting of two mirror symmetrical halves which constitute portions of two identical cylindrical surfaces, said concave and convex surfaces constituting portions of two additional cylindrical surfaces and the axes of said additional cylindrical surfaces being normal to the axes of said identical cylindrical surfaces.

52. Apparatus for transforming deformable sheet-like blanks, particularly semirigid blanks consistingof laminated cardboard, into containers of the type wherein two sidewalls having convex outer sides and neighboring marginal portions are integral and define distinct boundaries with an end wall having a concave outer side, comprising a blank converting unit including first and second deforming tools respectively having concave and convex surfaces which confront and are complementary to one another and are arranged to bear against the opposite sides of a substantially centrally located first portion of a blank which is flanked by two outer blank portions so that the first portion of the blank is converted into the end wall of the container, the concave and convex surfaces of said first and second tools respectively corresponding to the concave outer side and the convex opposite side of the thus formed end wall, said first and second tools further having first and second edges bounding the respective surfaces, and said unit further including a matrix defining a cavity for the passage of said tools, said cavity having an outline matching that of the deformed first portion of the blank between said tools, said matrix further having an edge bounding one end of said cavity and cooperating with the edge of at least one of said tools to define the boundaries between the deformed first portion and the outer portion of the blank which is held between said tools in response to penetration of said first tool into said cavity as well as to at least partially hold the outer portions of the blank between said tools along one of said tools; means for moving said tools relative to said matrix in a predetermined direction; means for transporting at least partially finished containers away from said unit, including at least one receptacle adjacent to the other end of said cavity and arranged to receive a deformed blank from said matrix in response to expulsio of such deformed blank by one of said tools, and means for conveying said receptacle substantially transversely of siad predetermined direction, said conveying means including means for conveying said receptacle stepwise along a predetermined path; and at least one additional unit adjacent to siad predetermined path and having means for treating the deformed blank which is delivered thereto by said receptacle, said additional unit including means for removing deformed blanks from and for reintroducing such blanks into said receptacle.

* * * * *